United States Patent [19]

Franzen

[11] 3,972,643

[45] Aug. 3, 1976

[54] ROTARY PUMP

[75] Inventor: Ingemar Franzen, Pforzheim, Germany

[73] Assignee: ITT Industries, Inc., N.Y.

[22] Filed: Mar. 28, 1975

[21] Appl. No.: 563,024

[30] Foreign Application Priority Data

Apr. 9, 1974 Sweden ..... 7404751

[52] U.S. Cl. ..... 415/146; 415/156; 417/424

[51] Int. Cl.[2] ..... F04D 27/02

[58] Field of Search ..... 415/146, 147, 197; 417/424

[56] References Cited

UNITED STATES PATENTS

| | | | |
|---|---|---|---|
| 2,701,526 | 2/1955 | Rotkin | 415/156 |
| 3,042,291 | 7/1962 | Greenwald | 415/156 |
| 3,304,876 | 2/1967 | Stahl | 415/197 |
| 3,490,685 | 1/1970 | Ferri | 415/146 |
| 3,552,888 | 1/1971 | Ericksson | 415/197 |
| 3,664,759 | 5/1972 | Biheller | 415/156 |

FOREIGN PATENTS OR APPLICATIONS

| | | | |
|---|---|---|---|
| 919,053 | 11/1946 | France | 415/53 |
| 957,884 | 5/1964 | United Kingdom | 415/156 |

*Primary Examiner*—Henry F. Raduazo
*Attorney, Agent, or Firm*—John T. O'Halloran; Peter Van Der Sluys

[57] ABSTRACT

A centrifugal pump with its impeller arranged beside the main media current in the pump housing (Vortex impeller pump) is provided with an inner part of resilient material which part forms the inlet of the pump. When a certain maximum volume goes into the pumphousing, the inlet edges fold inwards thus diminishing the inlet area and preventing the volume current from increasing over a certain value.

3 Claims, 3 Drawing Figures

ROTARY PUMP

BACKGROUND OF THE INVENTION

This invention relates generally to pumps, and more particularly to pumps which work totally submerged in the pumped medium, which medium may contain a large amount of solid bodies. Pumps of this kind may be used as drainage pumps and pumps for sewage water.

When pumping such media, it has been shown that the so-called Vortex impeller pumps have many advantages, especially over pumps of relatively small dimensions.

A Vortex impeller pump, unlike a conventional centrifugal pump, has its impeller arranged beside the main medium current. This means that the pumped medium never passes through the impeller. The pump effect is obtained by the whirls that the impeller generates in the medium current.

Therefore, the risk of stopping decreases considerably. This approach allows pumps of small dimensions to be used for pumping such media.

These types of pumps, however, possess a special quality which can be very disadvantageous. The efficiency will, for natural reasons, be somewhat lower at moderate media currents, compared with that of a conventional centrifugal pump. By increasing media currents, the difference in efficiency increases and at the same time the head of the Vortex impeller pump decreases considerably. When using Vortex impeller pumps it has been impossible to limit the volume current which means that the head has often been too low. Further, operating costs have been high.

SUMMARY OF THE INVENTION

It is an object of the present invention to provide a pump of the type mentioned above wherein the volume current can be limited in a simple way.

According to a broad aspect of the invention, there is provided a rotary pump of the Vortex impeller type comprising: a motor; a pump housing having an inlet opening; and an impeller coupled to said motor, the outer part of said housing being made of a rigid material and the inner part of said housing surrounding said impeller and said inlet opening being made of a resilient material.

The above and other objects of the present invention will be better understood from the following description taken in conjunction with the accompanying drawings, in which:

DESCRIPTION OF THE PREFERRED EMBODIMENT

Figure 1:
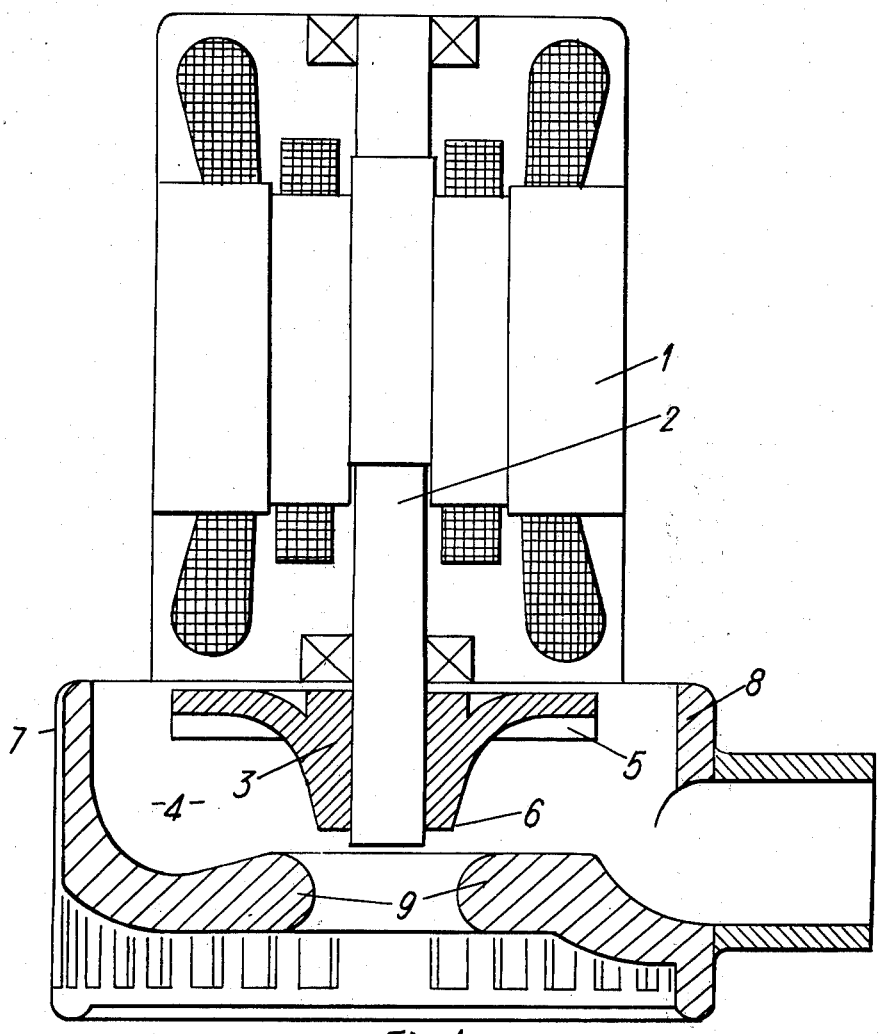
FIG. 1 shows an overall view of a pump according to the invention.
Figure 2:
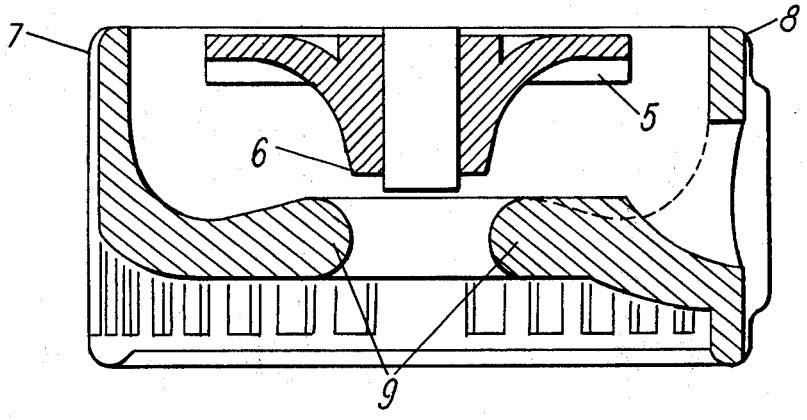
FIG. 2 shows the pump housing of FIG. 1 in more detail.

Referring to FIG. 1, a motor 1 is connected to an impeller 3 via a shaft 2 which rotates in a pump housing 4. As can be seen, the impeller having vanes 5 is arranged in the upper part of the pump housing and is provided with a relatively big hub 6 extending downwards in the pump housing. The pump housing consists of an outer part 7 made of a rigid material such as stainless sheetmetal having a simple shape. The inner parts of the pump housing 8 and 9 provide an inner surface which results in efficient pumping. The inner parts, 8 and 9, are made of a resilient material, such as rubber. Using this combination of materials, the necessity of a cast iron housing, which is much more expensive, is avoided.

Due to the shape of the hub 6 and the resilient part 9, the latter will be folded upwards against the hub 6 and thus throttle the inlet 10 when the volume current has reached a certain value and a certain pressure condition has arisen in the pump housing.

The increase of the volume current is then stopped and a constant value of this and the energy demand is obtained. By adapting the gap between the hub 6 and the part 9 and by using resilient materials of different qualities, the volume current and so the energy demand and head, can be chosen as required.

Sometimes it is extremely important to keep a uniform volume current, for instance in connection with sewage purification plants, where it will be possible to obtain an exact dosing of chemicals or the like, only by choosing the right time intervals.

Figure 3:
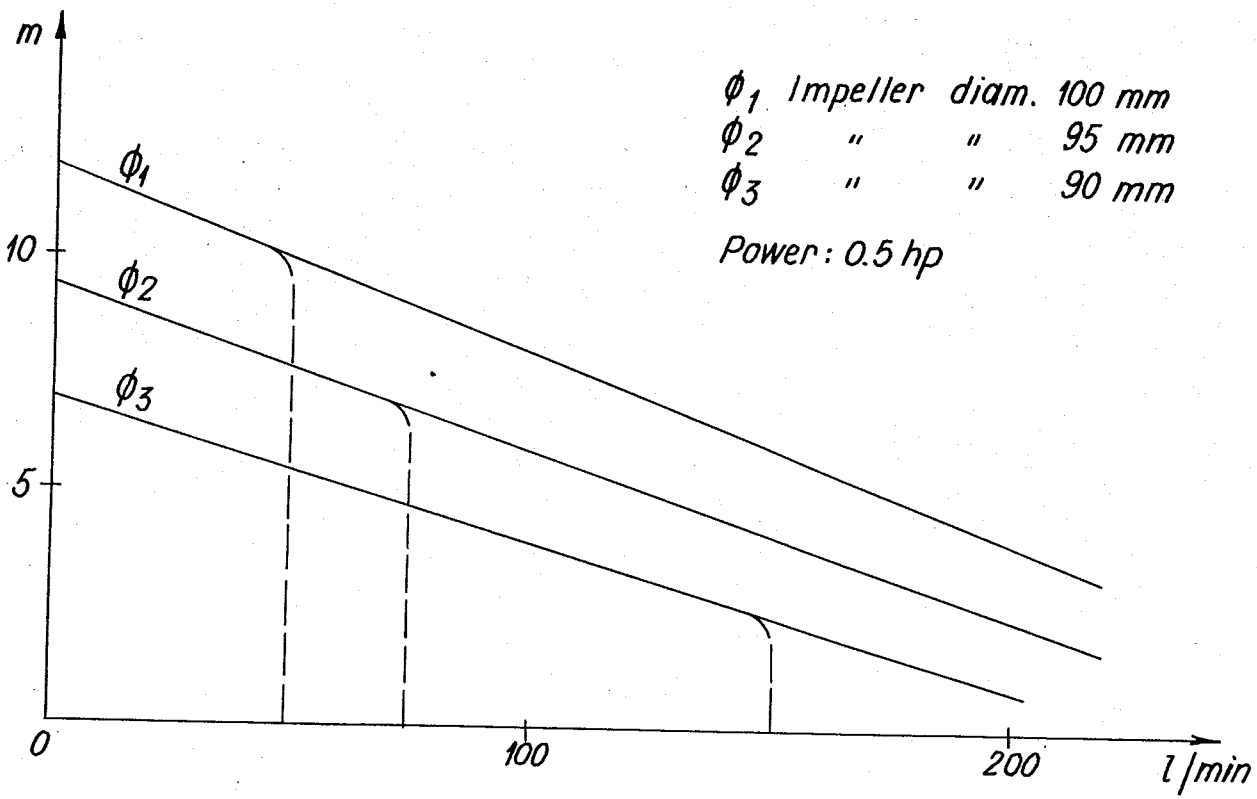
FIG. 3 is a graphical representation of several capacity curves.

In FIG. 3, examples of capacity curves for a pump with different types of impellers are shown. The solid curves show conditions in the pump when the inlet opening is not self-controlled. It can be seen from FIG. 3 that the head will go down to zero if the volume is allowed to expand unlimited. The dotted curves illustrate what happens when a pump with the self-controlled inlet opening is used. A volume current can be chosen, which is kept at a constant level, which gives a certain predetermined head.

Accordingly, a pump has been provided with a pump housing which is very simple and easy to manufacture and which consists of an outer part made of sheet metal and all inner parts of resilient material.

Further, the pump is self-controlled in such a way that the resilient material, which forms the pump inlet, automatically adapts for a certain maximum volume current. This makes the pump especially suitable as a dosing pump in a sewage purification plant where an exact dosing is very important for the function of the plant. Even in other respects the pump is very suitable for the pumping of waste water and the like because of its wide free throughway and slight tendency for stopping.

While the principles of the invention have been described above in connection with specific apparatus, it is to be clearly understood that this description is made only by way of example and not as a limitation on the scope of the invention.

What is claimed is:

1. A rotary pump of the Vortex impeller type comprising:

a motor;

a pump housing having an inlet opening; and an impeller coupled to said motor, said impeller having an axial extending hub, the outer part of said housing being made of a rigid material and the inner part of said housing surrounding said impeller and said inlet opening being made of a resilient material, said resilient material having a non-rigid edge which, in cooperation with said pump housing, forms said inlet opening so that a maximum volume current causes the non-rigid edge of said resilient material to fold inward toward said axial extending hub to diminishing the inlet area.

2. A rotary pump according to claim 1 wherein said resilient material is held by a flange.

3. A rotary pump according to claim 2 further said hub being a large hub coupled to and extending beneath said impeller which, together with said non-rigid edge, bounds said inlet area.

* * * * *